United States Patent [19]

Ciupak

[11] Patent Number: 5,003,855

[45] Date of Patent: Apr. 2, 1991

[54] CHOPPER WITH AUTO FEED

[76] Inventor: Lawrence F. Ciupak, 1106 Matterhorn Dr., Reynoldsburg, Ohio 43068

[21] Appl. No.: 299,582

[22] Filed: Jan. 23, 1989

[51] Int. Cl.[5] ..... D01G 1/04

[52] U.S. Cl. ..... 83/346; 83/913

[58] Field of Search ..... 83/343, 346, 403, 913

[56] References Cited

U.S. PATENT DOCUMENTS

| | | | |
|---|---|---|---|
| 2,278,662 | 4/1942 | Lodge | 83/403 |
| 3,485,120 | 12/1969 | Keith | 83/913 X |
| 3,557,648 | 1/1971 | Coffin et al. | 83/913 X |
| 3,861,257 | 1/1975 | Laird et al. | 83/913 X |
| 3,948,127 | 4/1976 | Vehling et al. | 83/913 X |
| 3,978,751 | 9/1976 | Farmer et al. | 83/403 |
| 4,014,231 | 3/1977 | Hutzezon | 83/913 X |
| 4,237,758 | 12/1980 | Lindner et al. | 83/403 |
| 4,369,681 | 1/1983 | Van Doorn et al. | 83/913 X |
| 4,569,264 | 2/1986 | Van Doorn et al. | 83/346 X |

*Primary Examiner*—Frank T. Yost

*Assistant Examiner*—Eugenia A. Jones

[57] ABSTRACT

A chopper having a feed mechanism for strands of continuous materials such as glass filaments includes an outer rotatable ring which receives and supports a plurality of radially oriented blades and an inner rotatable feed and pressure wheel disposed eccentrically within the outer ring. The ring and wheel are driven synchronously by a common drive unit such that the tangential speeds of the blade faces and pressure wheel are equal. The pressure wheel is positioned adjacent but not coincident to the circle defined by the inner faces of the blades. Continuous strands of material are provided to the chopper and a two position roller feeds the material to the feed and pressure wheel when its linear speed matches the tangential speed of the blades and wheel. The wheel directs the strands to the faces of the blades upon which the strands build up. As the thickness of the strands on the face of the blades increase, the wheel forces the strands further into the blades thereby cutting them. Centrifugal force moves the cut fibers to the periphery of the ring where they are collected.

18 Claims, 4 Drawing Sheets

CHOPPER WITH AUTO FEED

BACKGROUND OF THE INVENTION

The invention relates generally to apparatus for cutting continuous strands of material and more particularly for cutting continuous strands of material such as fiberglass and particularly wet fiberglass into short lengths, i.e., staple fibers or wet chop, in a continuous process.

As a reinforcing constituent of numerous materials, fiberglass has found broad application. Generally speaking, the matrix that short glass fibers forms when suspended in various plastics and organic materials is responsible for their toughness and ruggedness. In this application, it is desirable for the glass fibers to take the form of uniform short fibers or staples. The production of such staple fibers from continuously produced glass has been the object of much research and development.

For example, U.S. Pat. Nos. 3,485,120 and 3,557,648 disclose methods and apparatus for cutting elongated material of the type generally referred to as outside-in choppers. Here, a wheel with radially oriented blades disposed about its periphery receives the elongated material. Disposed adjacent the bladed wheel is an idler which forces the strands into the blades as the material builds up upon the bladed wheel. The cut fibers move radially inwardly and are harvested from the center of the wheel.

U.S. Pat. No. 3,861,257 teaches an inside out chopper that is, a chopper having blades in an outer position and idler and supply means in an inner position. In this device, the blades are fixed. A plurality of pressure rollers are rotatably supported on a central wheel and revolve about the center axis. The rollers are spring loaded. The elongate material is provided into the region between the outer faces of the rollers and the faces of the knife blades and the force of the rollers and increasing thickness of the material cuts the strands into short fibers which move radially outwardly through the blades.

U.S. Pat. No. 3,948,127 also teaches an inside out chopper. In this apparatus, knife blades are disposed in a ring or outer wheel which rotates about a center axis. Multiple pinch rollers though rotatable about their own axis are fixed in position. An endless belt traverses the rollers as well as a grouping of interior rollers one of which is spring loaded to maintain tension on the belt. The endless material such as tow is provided into the center of the machine and ooze out onto the endless belt. As the material builds up, it is forced into the knife blades and cut. Harvesting of the staple fibers is accomplished about the periphery of the knife ring. U. S. Pat. No. 3,978,751 discloses a similar chopper wherein a ring of knife blades are disposed in a ring and a belt circulates about the interior of the ring on a pair of symmetrical eccentric cams. The knife blades rotate and where the clearance between the cam supported belt and blades is the smallest, the fibers are cut.

Also of interest is the device disclosed in U. S. Pat. No. 4,369,681. Here a ring of inwardly facing knife blades is rotated while an idler having a diameter at least one half the inside diameter defined by the inner faces of the blades forces the fibers against the knife blade where they cut. The fibers are collected about the periphery of the knife ring. The pressure roller is not driven and includes mounting means which facilitate moving the roller from a working to a non-working position.

From the foregoing review of the prior art, it will be appreciated that improvements relating to the construction and operation of apparatus for chopping continuous strands of elongate material into short, staple fibers are not only desirable but possible.

SUMMARY OF THE INVENTION

An in-line chopper for strands of continuous materials such as glass filaments receives material directly from the producing bushing or other fabrication point and produces short, staple fibers therefrom. Even wet glass fibers are readily cut into short fibers by the present apparatus to provide the product known as wet chop. The apparatus includes an outer rotatable ring or annulus which receives and supports a plurality of radially oriented blades and an inner rotatable feed and drive wheel disposed eccentrically within the outer ring. The blades are received in closely spaced slots and the number of blades and thus the inter-blade spacing may be adjusted to adjust the length of the fiber produced. The ring and wheel are driven synchronously by a common drive unit such that the tangential speeds of the blade faces and feed wheel are equal. The surface of the feed wheel is positioned adjacent but not coincident to the circle defined by the inner faces of the blades. Continuous strands of material are drawn into the chopper by the feed wheel which directs the strands to the faces of the blades upon which the strands build up. As the thickness of the strands building up upon the face of the knives increases, the feed wheel forces the strands further into the blades, thereby cutting them. Centrifugal force moves the cut fibers to the periphery of the ring where they are collected. The chopper apparatus also includes a start-up feed assembly which initially feeds the strands of material to the feed wheel.

Thus it is an object of the present invention to provide an apparatus for the continuous production of fibers from a continuous supply of material strands.

It is a further object of the present invention to provide a chopper for the continuous production of glass fibers from a continuous supply of wet glass strands.

It is a further object of the present invention to provide an in-line chopper for glass fibers and the like which may be readily adjusted to provide different length fibers.

It is a still further object of the present invention to provide an in-line chopper for glass filaments and the like which functions when the fiber strands are wet thus eliminating the necessity to first dry the strands.

Further objects and advantages of the present invention will become apparent by reference to the following description of the preferred embodiment and attached drawings.

DESCRIPTION OF THE PREFERRED EMBODIMENT

Figure 1:
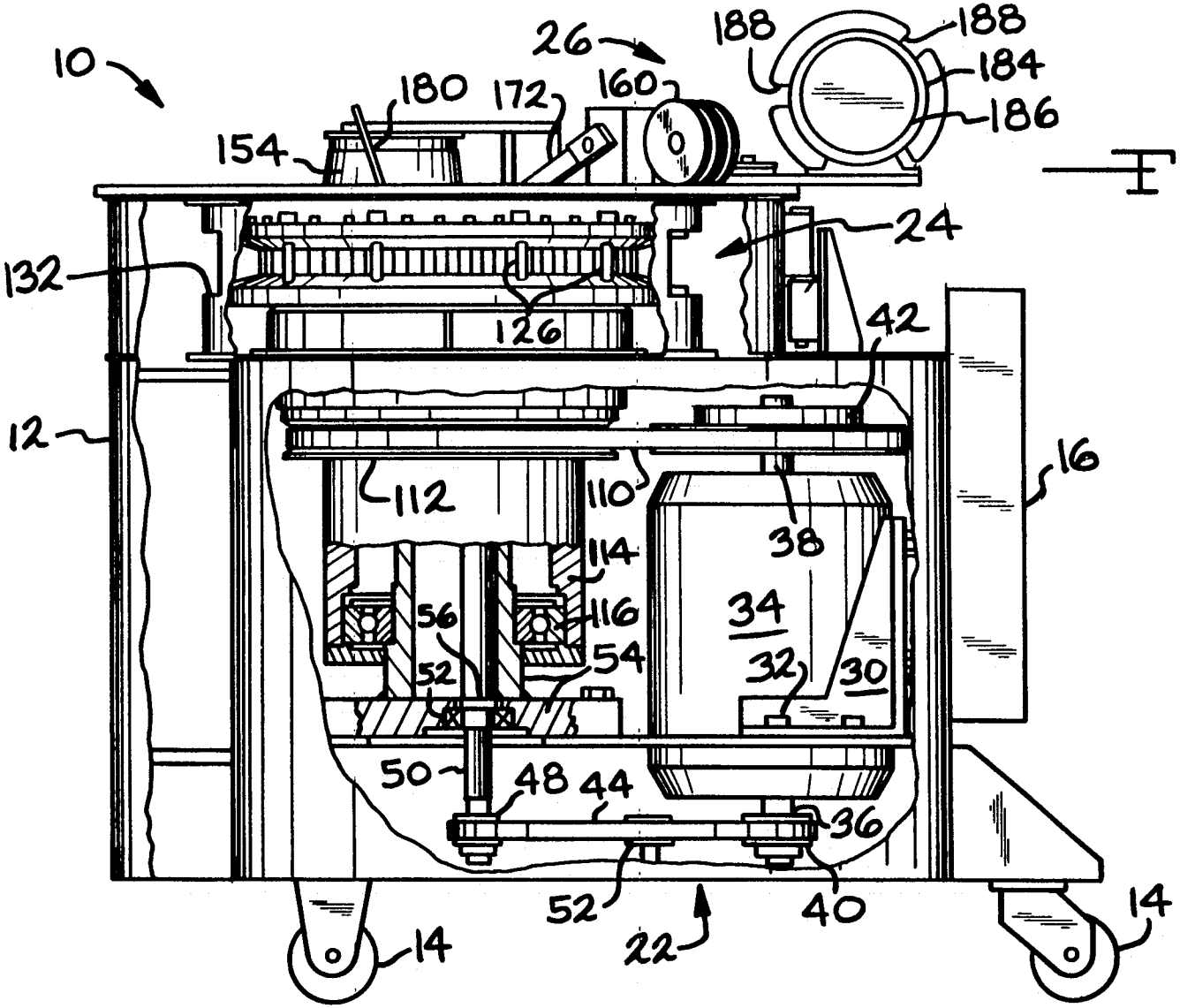
FIG. 1 is a side, elevational view of an in-line chopper according to the present invention with portions broken away and portions in partial section.

Referring now to FIG. 1, a chopper assembly according to the present invention is illustrated and generally designated by the referenced numeral 10. The chopper assembly 10 generally includes a cylindrical drum-like housing 12 which, if desired may be supported on casters 14 or other similar structures which facilitate moving and repositioning of the chopper assembly 10. As illustrated, the equipment is disposed in a vertical orientation. If desired, the chopper assembly 10 may be mounted in horizontal, through-the-wall orientation as those familiar with this general class of machinery will readily appreciate. The housing 12 also includes an electrical control panel 16 having appropriate electrical switching and drive equipment and other components (not illustrated) to provide electrical power to the chopper assembly 10 as will be more fully described below.

The chopper assembly 10 also includes a drive assembly 22, a cutter assembly 24 and a feed assembly 26.

Turning first to the drive assembly 22, there is secured to the housing 12, by a suitable bracket 30 and fasteners 32, a variable speed drive motor 34. The drive motor 34 includes a first, lower output shaft 36 and a second, upper output shaft 38. A first, smaller timing belt pulley 40 is secured to the first, lower output shaft 36 and a first, larger timing belt pulley 42 is secured to the second, upper output shaft 38. A first timing belt 44 is received by the first, smaller timing belt pulley 40 and transfers energy to a second, smaller timing belt pulley 48 secured to a shaft 50. A tensioning wheel or idler 52 is positioned intermediate the first, smaller timing belt pulley 40 and second, smaller timing belt pulley 48 and engages the timing belt 44 to facilitate tension adjustment thereof in accordance with conventional practice.

Figure 2:
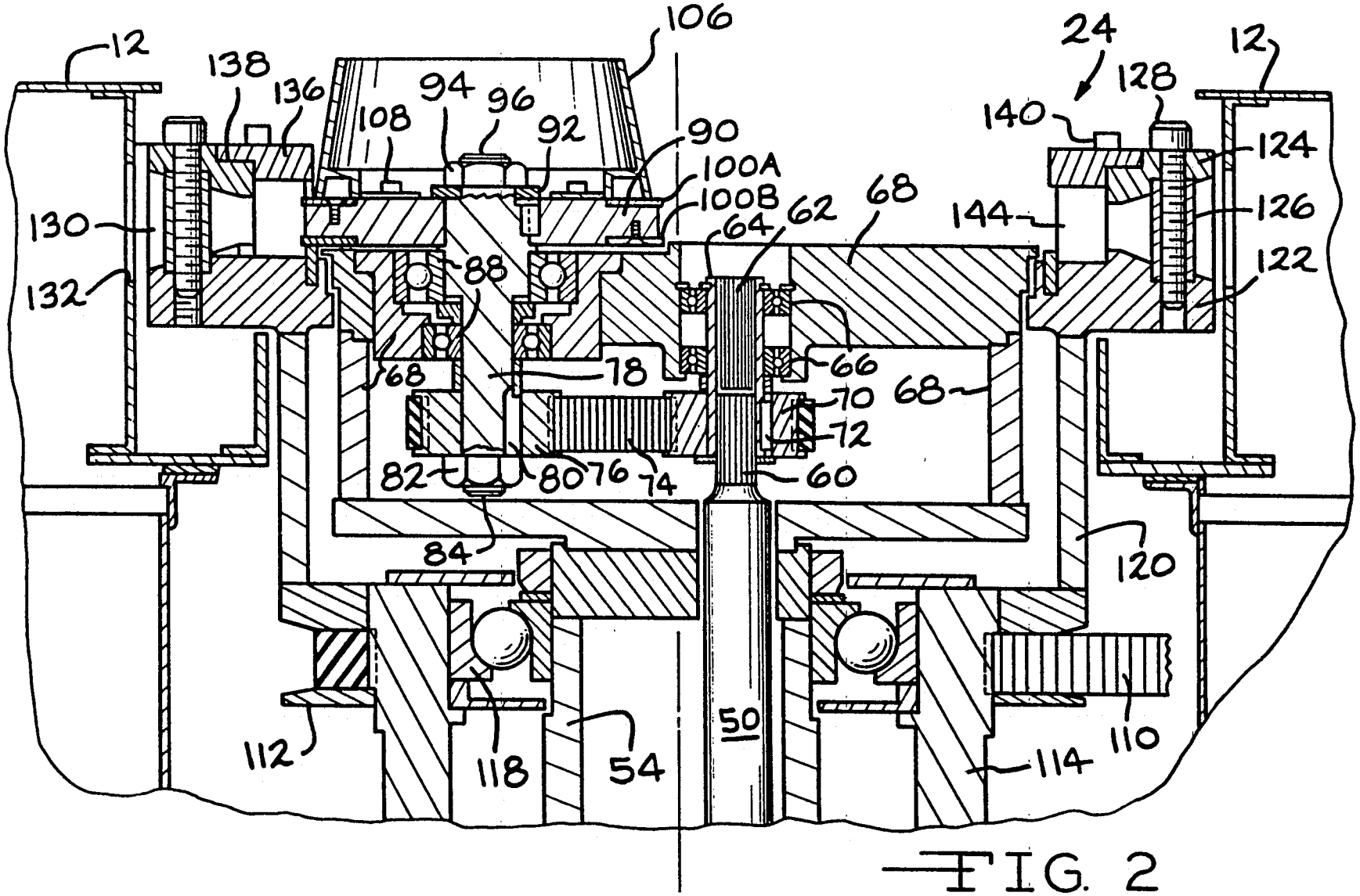
FIG. 2 is a full sectional view of the upper portion an in-line according to the present invention.

Referring now to FIGS. 1 and 2, the shaft 50 is disposed vertically and is supported in an anti-friction bearing such as a ball bearing 52. The ball bearing 52 is in turn supported in a frame member 54 which constitutes a portion of the drive assembly 22 and supports the housing 12. The vertical (axial) position of the shaft 50 is maintained by an enlarged diameter region such as a collar 56 which engages the ball bearing 52. The upper terminus of the shaft 50 defines male splines 60. The male splines 60 of the shaft 50 are received within and engaged by female splines 62 of a bushing tube 64. The tube bushing 64 is supported by a pair of anti-friction bearings such as ball bearings 66. The ball bearings 66 are in turn supported by stationary frame members 68. Generally axially aligned with the male splines 60 of the shaft 50 is a timing belt pulley 70. The timing belt pulley 70 is secured to the bushing tube 64 by a key 72 and receives and transfers rotary energy to a timing belt 74. The timing belt 74 is in turn received about the second timing belt pulley 76 disposed around a stub shaft 78. The second timing belt pulley 76 may be secured to the stub shaft 78 by a keyway 80 and a threaded fastener 82 which is tightened down on a complementarily threaded end 84 of the stub shaft 78. The stub shaft 78 is in turn rotatably supported by a pair of anti-friction bearings such as ball bearings 88 which in turn are supported by the stationary frame members 68.

Figures 3, 4:
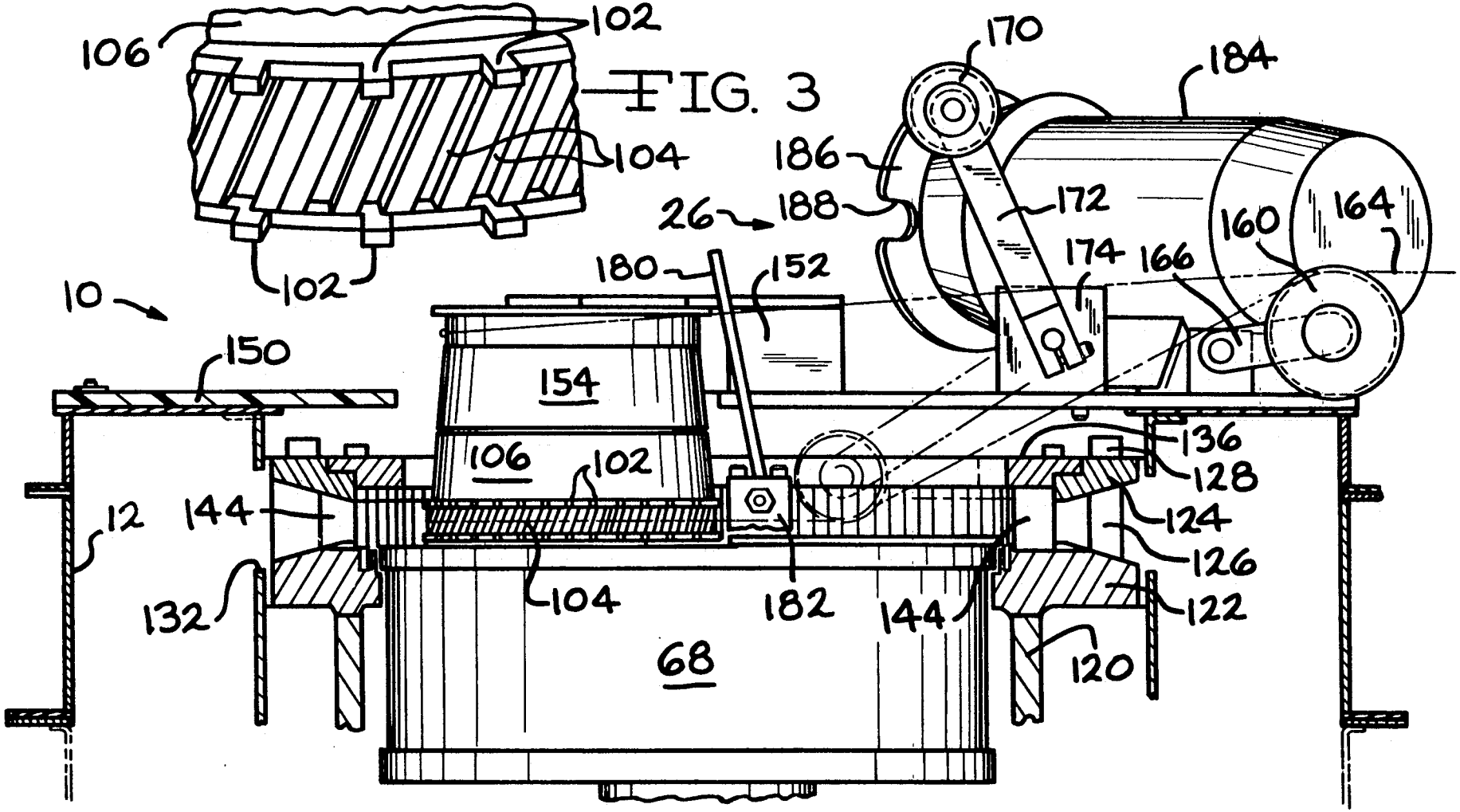
FIG. 3 is an enlarged, side elevational view of the feed and drive wheel of an in-line chopper apparatus according to the present invention.
FIG. 4 is a side, elevational view in partial section of an in-line chopper apparatus according to the present invention which illustrates details of the start-up feed mechanism.

Referring now to FIGS. 2 and 3, a feed which 90 is secured to the upper end of the stub shaft 78 by a key 92 and a threaded fastener 94 which is tightly secured to a complementarily threaded terminal portion 96 of the stub shaft 78. The feed wheel 90 includes a pair of toothed rings 100A and 100B disposed in axially spaced apart relationship about its periphery. The toothed rings 100A and 100B are secured in suitable complementary recesses formed in the upper and lower faces of the feed wheel 90 by suitable fastening means such as threaded fasteners. Each of the two toothed rings 100A and 100B include a like plurality of teeth 102 which extend radially slightly beyond the face of the feed wheel 90. The teeth 102 of the upper ring 100A are vertically (axially) aligned with the teeth 102 of the lower ring 100B. The face of the feed wheel 90 defines a plurality of oblique kerfs 104 disposed at an angle of approximately 30°. The width of the kerfs 104 is preferably equal to their spacing and to their depth, as well. A rotating frusto-conical guide 106 having a diameter slightly less than the diameter of the feed wheel 90 is secured thereto by suitable fasteners 108.

Referring again to FIG. 1, the first, larger timing belt pulley 42 on the upper output shaft 38 of the variable speed drive motor 34 receives a timing belt 110 which transfers rotary energy to a second, larger timing belt pulley 112 secured to and supported by a cylindrical drive member 114. The drive member 114 is rotatably supported at its lower terminus by an anti-friction assembly such as a ball bearing 116 which is in turn supported by the stationary frame members 54. It will be appreciated that the incorporation of the timing belts 44 and 110 and the associated pulleys results in synchronous rotation of the feed wheel 90 and the drive member 114. It will also be appreciated that the feed wheel 90 and the drive member 114 rotate in the same direction.

Referring again to FIG. 2, the cutter assembly 24 will next be described. The upper terminus of the cylindrical drive member 114, that is, that portion generally proximate the second, larger timing belt pulley 112 is rotatably supported by an anti-friction assembly such as a ball bearing 118. Secured thereto and rotating with the cylindrical drive member 114 is an annular drive member 120. The annular drive member 120 is in turn secured to a lower annulus 122 and an upper annulus 124 which are releasably fastened together by suitable spacers 126 and threaded fasteners 128. The lower annulus 122 and upper annulus 124 define a throat 130 which increases in height in the radially outward direction. A substantially continuous opening 132 is defined by the housing 12 and is aligned with the throat 130 as shown. The cutter assembly 24 also includes an inner annulus 136 which is received within a shoulder 138 of the upper annulus 124. The inner annulus 136 is secured to the upper annulus 124 and the lower annulus 122 by a plurality of threaded fasteners 140 which extend through the inner annulus 136 and into the lower annulus 122.

Disposed between the inner annulus 136 and the lower annulus 122 are a plurality of knife blades 144 having inwardly radially directed cutting edges 146. Each of the knife blades 144 is received within an axially aligned pair of a plurality of radial slots 148 formed in the inner annulus 136 and lower annulus 122. The circumferential spacing between the radial slots 148 corresponds to the minimum fiber length to be fabricated by the chopper assembly 10. Typically, this distance may be on the order of 0.125 inches. When longer fibers are required, the knife blades 144 are removed to provide blade-to-blade spacing which provides the required fiber length. That is, with a knife blade 144 in every fourth slot 148 as illustrated, fibers 0.5 inches in length will be provided. With a knife blade 144 in every eighth slot 148, fibers of an inch in length will be provided.

The cutting edges 146 of the knife blades 144 are the sharpened edges which cut the fibers. The spacing at the nip between the face of the feed wheel 90 and the reference circle defined by the inner edges 146 of the knife blades 144, that is, the spacing along a reference line passing through the center of the feed wheel 90 and the center of the reference circle of the cutting edges 146 of the knife blades 144, is preferably about, 0.005 inches ±0.002 or greater depending upon variables relating primarily to the material supplied to and chopped by the assembly 10. Obviously, larger diameter material may require a larger spacing and vice versa. Generally, the spacing must be not so small as to cause cutting of the material on its first pass between the knife blades 144 and feed wheel 90 but not so large as to fail to grip the material and draw it into the cutter assembly 24 at start up. The reference circle defined by the cutting edges 146 of the knife blades 144 has additional significance. First of all, and most importantly, it is the tangential velocity of this circle which must equal the tangential velocity of the face of the feed wheel 90 at the nip between them. (The term tangential velocity is used in its classic, vector sense to refer to both magnitude and direction. Thus, not only are the tangential speeds of the cutting edges 146 of the knife blades 144 and the surface of the feed wheel 90 equal, but also the direction of such rotation is the same at the nip between the edges 146 of the blades 144 and feed wheel 90, as defined above.) This is necessary to ensure that there is no layer-to-layer shifting or sliding of fiber strands as they accumulate on the cutting edges 146 of the knife blades 144. Such action typically results in random and inaccurate cut fiber length. As noted above, the drive assembly 22 is directed to achieving equal tangential velocities of these components. Secondly, the axis of the feed wheel 90 is preferably spaced from the axis of the upper and lower annuli 122 and 124, respectively, (and the axis of the reference circle defined by the cutting edges 146 of the knife blades 144) by a distance greater than one quarter the diameter (or one-half the radius) of the reference circle.

Referring again to FIG. 1 and also FIGS. 2 and 4, the feed assembly 26 will now be described. At the top of the housing 12 is positioned a strong, rigid guard plate 150 which is preferably fabricated of Plexiglas or other similar material having suitable strength characteristics but which is also transparent such that the operation of the chopper assembly 10 may be viewed therethrough. Secured to the guard plate 150 by a suitable bracket 152 is a stationary frusto-conical guide 154. The stationary frusto-conical guide 154 is disposed coaxially with the rotating frusto-conical guide 106, the angles of incline of the frusto-conical guides 106 and 154 are equal, the upper edge of the rotating frusto-conical guide 106 is disposed adjacent the lower edge of the stationary frusto-conical guide 154 and the diameter of the upper terminus of the rotating frusto-conical guide 106 is substantially equal to the lower terminus of the stationary frusto-conical guide 158 such that the two guides 106 and 154 form a substantially continuous frusto-conical surface.

Figures 5, 6:
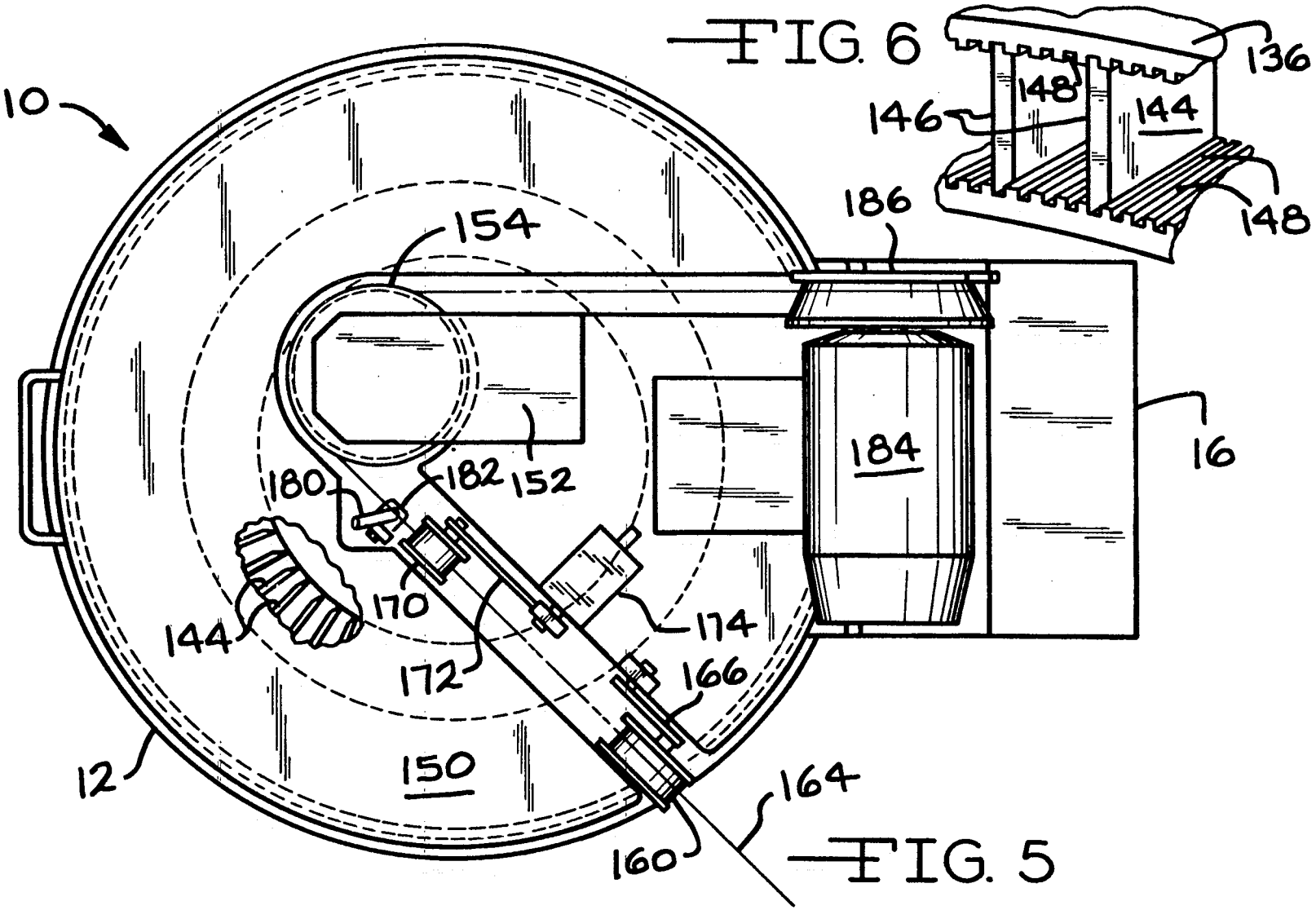
FIG. 5 is plan view of an in-line chopper apparatus the present invention.
FIG. 6 is an enlarged, perspective view of the blades of an in-line chopper apparatus according to the present invention.

The feed assembly 26 also includes a guide roller 160 which receives and guides material strands 164. The guide roller 160 is supported upon an adjustable bracket 166. Thus, the position of the roller 160 may be adjusted, as desired, to assist guiding the material strands 164 to the chopper assembly 10. A feed roller 170 is rotatably mounted upon an arm 172 which is in turn secured to a two position rotary actuator 174. In FIG. 4, the feed roller 170 is illustrated in the relaxed, non-feed position and dotted reference lines, generally located approximately 90 degrees counterclockwise from the non-feed position, illustrate the position of the feed roller 170 and arm 172 in the feed position. An oblique fixed guide 180 is disposed between the feed roller 170 and the frusto-conical guides 106 and 154. The orientation of the fixed guide 180 is toward the guides 106 and 154 relative to its base 182 when viewed as illustrated in FIG. 4 but, when viewed from above, as in FIG. 5, is away from the guides 106 and 154 relative to its base 182. Thus, the fixed guide 180 generally defines a V-shaped throat with the inclined surfaces of the guides 154 and 106 as seen by the material strands 164 as they pass between the stationary guide 180 and conical guides 106 and 154.

Finally, the drive assembly 26 includes a variable speed feed motor 184 having a strand receiving pulley 186 with a plurality of notches 188 in one wall. The notches 188 facilitate engaging the material strands 164 in the pulley 186 and feeding of the strands 164 through the chopper assembly 10 and specifically the feed assembly 26.

The operation of the chopper assembly 10 will now be described. At the outset, it will be appreciated that the material strands 164 to be cut by the chopper assembly 10 will be threaded as illustrated by the upper dashed line 164, that is, material the strands 164 will engage the guide roller 160 and generally pass about and around the upper portion of the stationary frusto-conical guide 154. Electrical energy is provided to the variable speed drive motor 34 and the cutter assembly 24 brought up to a desired rotational speed. This rotational speed is the speed which results in the tangential speed of the cutting edges 146 of the knife blades 144 and of the feed wheel 90 being equal to the linear speed of the material strands 164 at which they are being fed into the chopper assembly 10 by associated equipment (not illustrated) or, if it is receiving freshly drawn fibers such as E-glass from a nearby bushing, that speed which provides proper strand attenuation and final diameter. As noted previously, the cutter assembly 24 and the feed wheel 90 are driven in synchronism such that the tangential velocities measured at the nip between the cutting edges 146 of the knife blades 144 and the surfaces of the oblique curves 104 are equal.

The feed motor 184 is then activated and the material strands 164 are engaged in one of the notches 188 such that the strands 164 are drawn about the stationary frusto-conical guide 154 and wrapped about the pulley 186. The speed of the feed motor 184 is then adjusted until the linear velocity of the material strands 164 through the feed assembly 26 matches the tangential velocity of the cutting edges 146 of the knife blades 144 and tangential velocity of the feed wheel 90. When these linear and tangential velocities are the same, the actuator 174 may be activated, moving the feed roller 170 from the position illustrated in FIG. 4, to the position illustrated in dashed lines, driving the material strands 164 downward into the cutter assembly 24 and feeding it onto the face of the feed wheel 90. The teeth 102 on the rings 100A and 100B assist such feeding onto the face of the feed wheel 90 by engaging and pulling the material strands 164. As the feed wheel 90 rotates, the material strands 164 pass through the nip defined by the face of the feed wheel 90 and the cutting edges 146 of the knife blades 144. The material strands 164 thus feed onto the cutting edges 146 of the knife blades 144. As the quantity of strands of material 164 on the edges 146 of blades 144 increases, the feed wheel 90 will apply pressure to the material strands 164 and those on the edges 146 of the knife blades 144 will be cut. Due to the rotation of the cutter assembly 24, the freshly cut fibers will be ejected out the throat 130 by centrifugal force and be harvested in the housing 12.

Thus it will be appreciated that a chopper assembly 10 according to the present invention has several features and advantages. First of all, it is intended for use in an in-line production environment wherein the strands of material such as glass of other material are produced and immediately provided directly to the chopper assembly 10 such that the production and cutting of the fibers are achieved in a single, continuous process which eliminates intermediate handling of the fibers. Secondly, the chopper assembly 10 accepts wet strands, such as E-glass strands, directly from bushings. The wet chop produced by the chopper assembly 10 is thus ready for packaging and shipment without further handling, treatment or processing.

This capability is primarily the result of two features of the chopper assembly. First of all, the feed roller 90 is driven rather than operating as an idler wheel as analogous structures in other prior art designs do. Second of all, the tangential speeds of the surface of the feed roller 90 and the reference circle defined by the cutting edges 146 of the knife blades 144 are equal. At the nip between the surface of the feed wheel 90 and edges 146 of the knife blades 144, the tangential velocities are equal. Thus, only radial, cutting forces are applied to the material strands 164 as they pass between the edges 146 of the knife blades 144 and the feed wheel 90. This eliminates shifting and sliding of the material strands 164 relative to one another which can result in the production of random length, inaccurately cut fibers. Finally, it will be appreciated that, with relative ease, the length of fibers produced by the chopper assembly 10 may be changed. To effect a change in the produced fiber length, the threaded fasteners 140 are removed and the inner annulus 136 is likewise removed. Then, additional knife blades 144 are added if shorter fibers are to be produced or knife blades 144 are removed if longer fibers are to be produced. Preferably, of course, the blade-to-blade spacing is constant about the cutter assembly 24 unless, of course, is desired to produce fibers of disparate lengths. In this case, the number of pairs of knife blades 144 at given intervals should be in proportion to the required proportions of various length fibers.

The foregoing disclosure is the best mode devised by the inventor for practicing this invention. It is apparent, however, that apparatus incorporating modifications and variations will be obvious to one skilled in the art of fiber production. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. An apparatus for cutting strands of material into short lengths comprising, in combination, means for supporting a plurality of circumferentially spaced apart, radially oriented blades about an axis, said blades having inwardly disposed cutting edges, a first drive shaft disposed on said axis coupled to said supporting means, a wheel having an annular surface disposed adjacent said cutting edges, a second drive shaft coupled to said wheel, and drive means for revolving said cutting edges at a tangential speed about said axis and rotating said annular surface of said wheel at said tangential speed, said drive means including a motor output and means for positively coupling said motor output to said first drive shaft and said second drive shaft.

2. The apparatus of claim 1 wherein said means for positively coupling includes a timing belt .

3. The apparatus of claim 1 wherein said means for supporting a plurality of blades includes a pair of axially spaced apart annuli defining axially spaced apart pairs of radially oriented slots for receiving said blades.

4. The apparatus of claim 1 wherein said annular surface is flanked by axially aligned circumferentially spaced apart teeth.

5. The apparatus of claim 1 further including feed means for selectively providing said strands of material to the nip between said cutting edges and said annular surface, said feed means including at least a guide roller moveable between a first, non-feeding position and a second, feeding position.

6. The apparatus of claim 1 further including a frustoconical surface extending axially from said annular surface.

7. The apparatus of claim 1 wherein said annular surface and said cutting edges define a nip and said cutting edges and said annular surface move at the same tangential velocity at said nip.

8. An apparatus fur cutting strands of material to short fibers comprising, in combination, a member supported for rotation about a first axis, said member including a plurality of circumferentially spaced apart, radially oriented blades having inwardly directed cutting edges, a first drive shaft disposed on said first axis and coupled to said member, a wheel defining a peripheral face, said wheel disposed within said member and supported for rotation about a second axis spaced from said first axis, a second drive shaft disposed on said second axis and coupled to said wheel, means coupled to said member and said wheel for driving said cutting edges of said blades and said face of said wheel at the same tangential speed, said just recited means including a motor having at least one output shaft and means for positively coupling said output shaft to said first drive shaft and said second drive shaft, whereby the rotation of said first shaft and said second shaft is synchronized.

9. The apparatus of claim 8 wherein said face of said wheel defines a plurality of obliquely oriented kerfs.

10. The apparatus of claim 8 further including feed means for selectively providing said continuous strands of material to said wheel, said feed means including at least a guide roller moveable between a first, non-feeding position and a second, feeding position.

11. The apparatus of claim 8 wherein said member includes an upper annular portion and a lower annular portion, said annular portions including a plurality of axially aligned radial slots for receiving said blades.

12. The apparatus of claim 8 wherein said wheel includes a plurality of pairs of axially aligned, circumferentially spaced apart teeth disposed about the periphery of said wheel.

13. The apparatus of claim 8 wherein said first and said second axes are spaced apart at least one quarter the diameter of the circle defined by said cutting edges of said blades.

14. The apparatus of claim 8 further including a frusto-conical guide secured to said wheel and disposed in axial alignment with a stationary frusto-conical guide.

15. The apparatus of claim 8 wherein said cutting edges and said face define a nip and the tangential velocities of said cutting edges and said face are equal at said nip.

16. An apparatus for cutting continuous strands of material to short length fibers comprising, in combination, an annulus supported for rotation about a first axis, said annulus including a plurality of circumferentially spaced apart, radially oriented blades having inwardly directed cutting edges arranged in a circle, a first drive shaft disposed on said first axis and coupled to said annulus, a wheel defining a peripheral face, said wheel disposed within said annulus and supported for rotation about a second axis spaced from and parallel to said first axis, a second drive shaft disposed on said second axis and coupled to said wheel, a nip defined by said circle of cutting edges and said peripheral face, and drive means coupled to said annulus and said wheel for driving said circle of cutting edges and said peripheral face at the same tangential velocity at said nip, said drive means including a motor having an output shaft and means for positively coupling said output shaft to said first drive shaft and second drive shaft.

17. The apparatus of claim 16 wherein said nip is about 0.005 inches ± 0.002 inches.

18. The apparatus of claim 16 further including feed means for selectively providing said continuous strands of material to said wheel, said feed means including at least a guide roller moveable between a first, non-feeding position and a second, feeding position.

* * * * *